US005177843A

United States Patent [19]

Hayashi

[11] Patent Number: 5,177,843

[45] Date of Patent: Jan. 12, 1993

[54] TURRET PUNCH PRESS

[75] Inventor: Tetsuji Hayashi, La Mirada, Calif.

[73] Assignees: Amada Company, Ltd., Japan; Amada Mfg America, Inc., La Mirada, Calif. ; a part interest

[21] Appl. No.: 807,586

[22] Filed: Dec. 16, 1991

[51] Int. Cl.[5] ..... B23B 29/24; B21D 43/00

[52] U.S. Cl. ..... 29/33 J; 72/332; 72/447

[58] Field of Search ..... 29/33 J; 483/24, 25; 72/340, 324, 352, 442, 446, 447, 326, 327, 452, 455, 481, 332; 83/623, 685, 700

[56] References Cited

U.S. PATENT DOCUMENTS

| | | | |
|---|---|---|---|
| 3,739,669 | 6/1973 | Seki | 83/685 X |
| 3,752,028 | 8/1973 | Walzmann | 83/700 X |
| 3,777,601 | 12/1973 | Strandell | 83/623 X |
| 4,114,217 | 9/1978 | Akamatsu | 72/352 |
| 4,212,184 | 7/1980 | Falch | 72/340 |
| 4,914,938 | 4/1990 | Ishinaga | 72/452 |
| 4,918,956 | 4/1990 | Schoch | 72/446 X |

FOREIGN PATENT DOCUMENTS

| | | | |
|---|---|---|---|
| 823286 | 3/1952 | Fed. Rep. of Germany | 29/33 J |

*Primary Examiner*—William Briggs
*Attorney, Agent, or Firm*—Wigman & Cohen

[57] ABSTRACT

A disc support 23 is provided under a lower turret 21 to support the lower turret 21 against the impact thereto. The disc support 23 includes a movable block comprising a through-hole 77 through which scraps are discharged and a press cylinder 79 to push up a lower tool 19 for forming. In a punching operation, the through-hole 77 is arranged in the working area and scraps are discharged from the through hole 77. In a forming operation, the press cylinder 79 is arranged in the working area and pushes up the lower tool 19 to project above a pass line for a workpiece. Since the lower tool 19 is positioned below the pass line, the workpiece W cannot be damaged. Further, the workpiece W is not obstructed by the lower tool 19 when the workpiece W is positioned in the working area and the turrets are rotated, thus forming is properly performed.

6 Claims, 5 Drawing Sheets

TURRET PUNCH PRESS

BACKGROUND OF THE INVENTION

The present invention relates to a turret punch press, and more particularly to a turret punch press able to process a workpiece without causing damage to the workpiece.

A conventional turret punch press comprises a rotatable upper turret provided with upper tools and a rotatable lower turret provided with lower tools. The upper and lower tools include a plurality of upper and lower tools for punching a workpiece and a plurality of upper and lower tools for forming a workpiece, respectively. A movable striker is vertically mounted so as to strike the upper tool positioned in a working area where the workpiece is processed. A disc support for supporting the lower turret when the striker hits the upper tool is provided under the lower turret.

In the above turret punch press, to perform forming, the top ends of the lower tools for forming are positioned above a pass line (feed level height) for the workpiece. As a result, the punch press includes the following faults:

1. Workpiece damage. The workpiece is damaged when it touches the lower tools for forming during the positioning of the workpiece. Further, the workpiece is damaged when it is punched while being placed on the lower tools for forming.

2. Workpiece inclined. The workpiece is inclined when it is placed on both the lower tool for punching and the lower tool for forming. Thus, proper processing cannot be achieved.

SUMMARY OF THE INVENTION

An object of the present invention is to provide a turret punch press having upper and lower tools for punching and forming wherein the machine can process a workpiece without causing damage to the workpiece.

Another object of the present invention is to provide a turret punch press of the above stated type wherein the machine can maintain the workpiece in a level state while processing the workpiece.

These objects are achieved in the present invention by the provision of an improved turret punch press as described below. The turret punch press comprises rotatable upper and lower turrets. The upper turret is provided with at least an upper tool for punching and an upper tool for forming. The lower turret is positioned to oppose the upper turret, and is provided with at least a lower tool for punching and a lower tool for forming. The lower tool is normally arranged not to project above a pass line for the workpiece. A movable ram is provided to vertically act on the upper and lower tools which are positioned in a working area where a workpiece is processed. A disc support is provided in the working area under the lower turret, for supporting the lower turret. The disc support includes means for pushing up the lower tool for forming, positioned in the working area so that the upper end of the lower tool projects above the pass line during a forming operation.

BRIEF DESCRIPTION OF THE DRAWINGS

These and other objects, features, and advantages of the present invention will become more apparent from the following description of the preferred embodiment taken in conjunction with the accompanying drawings, in which.

DETAILED DESCRIPTION OF THE PREFERRED EMBODIMENTS

Other features of this invention will become apparent in the course of the following description of exemplary embodiments which are given for illustration of the invention and are not intended to be limiting thereof.

Figure 7:
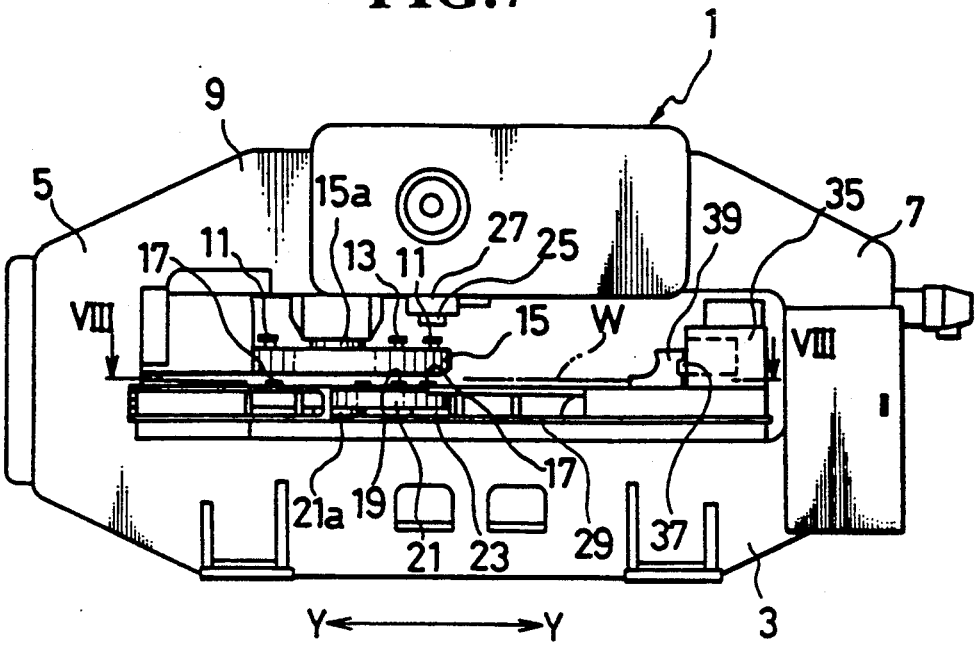
FIG. 7 is a front elevation of the turret punch press according to the invention.
Figure 8:
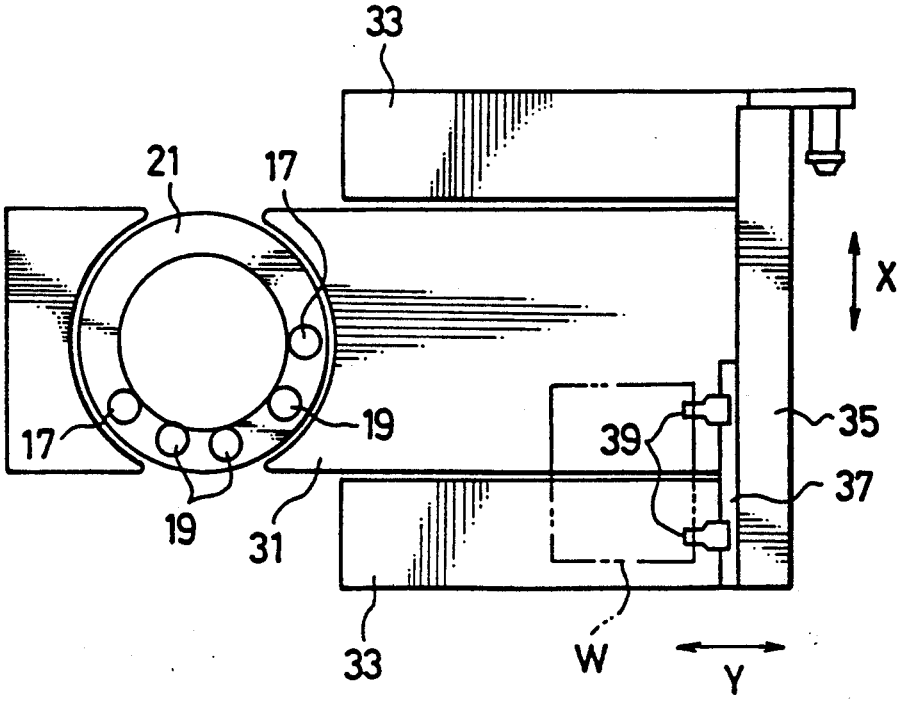
FIG. 8 is a plan view taken along the line VIII—VIII of FIG. 7.

As shown in FIGS. 7 and 8, a turret punch press 1 comprises a base 3, side frames 5, 7 provided on both sides of the base 3, and an upper frame 9 provided on the side frames 5, 7. A disk-like upper turret 15 is rotatably supported by an upper rotation axis 15*a* under the upper frame 9. A plurality of upper tools 11 for punching a workpiece W and upper tools 13 for forming of the workpiece W are removably installed on the upper turret 15. A disk-like lower turret 21 is rotatably supported by an lower rotation axis 21*a* opposing the upper turret 15 and above the base 3. A plurality of lower tools 17 for punching the workpiece W and lower tools 19 for forming of the workpiece W are removably installed on the lower turret 21. A disc support 23 is secured on the base 3 under the lower turret 21. A ram 27 having a striker 25 for striking the upper tools 11, 13 is provided on the upper frame 9.

The upper and lower turrets 15, 17 are synchronously rotated by a servo motor (not shown) installed on the frames. Thus, during a punching operation, the desired upper and lower tools 11, 17 for punching are positioned in a working area where the workpiece W is processed. During a forming operation, the desired upper and lower tools 13, 19 for forming are positioned in the working area.

A pair of guide rails 29 extending in the Y direction (FIG. 7) are provided on the base 3. A pair of movable tables 33 are positioned, one on each side of a fixed table 31, and supported on the guide rails 29. The movable tables 33 are attached to a carriage base 35 extending in the X direction (FIG. 8) bridging the fixed table 31. A carriage 37 movable in the X direction perpendicular to the moving direction of the movable table 33 (Y direction) is provided on the carriage base 35. The carriage 37 is provided with a clamp device 39 for clamping an end of the workpiece W.

Thus, positioning of the workpiece W is controlled by moving the carriage 37 on the carriage base 35 in the X direction and by moving the carriage 37 on the guide rail 29 in the Y direction.

As shown in FIGS. 5 through 8, a plurality of upper tools 11 for punching are removably installed on the upper turret 15, and a plurality of upper tools 13 for forming are removably installed in tool installation holes 41 in the upper turret 15. The configuration of the upper tool 11 for punching is well known in the art, and therefore will not be described in detail. The upper tool 13 for forming is provided with a punch body 43 with a recess 45 at its lower end. The punch body 43 has a flange 47 at its upper end. A spring 49 which normally presses the flange 47 upward is provided between the flange 47 and the upper turret 15. The punch body 43 is slidably installed in a punch guide 51 mounted on the upper turret 15. The punch body 43 is supported by a spring 53 at the upper end of the punch guide 51. The spring constant of the spring 53 is larger than that of the spring 49. A flange 55 is formed projecting outward from the upper end of the punch guide 51 to keep the punch guide 51 from dropping through the hole 41.

A plurality of lower tools 17 for punching are removably installed on the lower turret 21; a plurality of lower tools 19 for forming are removably installed in tool installation holes 57 in the lower turret 21. The configuration of the lower tool 17 for punching is well known in the art, and therefore will not be described in detail. The lower tool 19 for forming comprises a die holder 59, a die chip 61 integrally formed on the die holder to be inserted into the recess 45 of the punch body 43, and a work ejector 63 vertically movable with respect to the die chip 61. A spring 67 is provided between the work ejector 63 and the die holder 59 to push up the ejector 63. A spring 69 is provided between the die holder 59 and a flange 65 which is formed in the tool installation hole 57 to push down the die holder 59. Thus, the lower tool 19 in a normal state does not project above a pass line PL (the feed line for the workpiece W).

The disc support 23 comprises a hollow rectangular parallelepiped block, as shown in FIGS. 1 through 4 with apertures on the right side and on the upper and lower sides. Both side walls 23*a* and 23*b* mainly support the lower turret 21 from the underside. The thickness of the side walls 23*a* and 23*b* is determined so that the cross-sectional area thereof is larger than a predetermined area subject to pressure.

Figure 5:
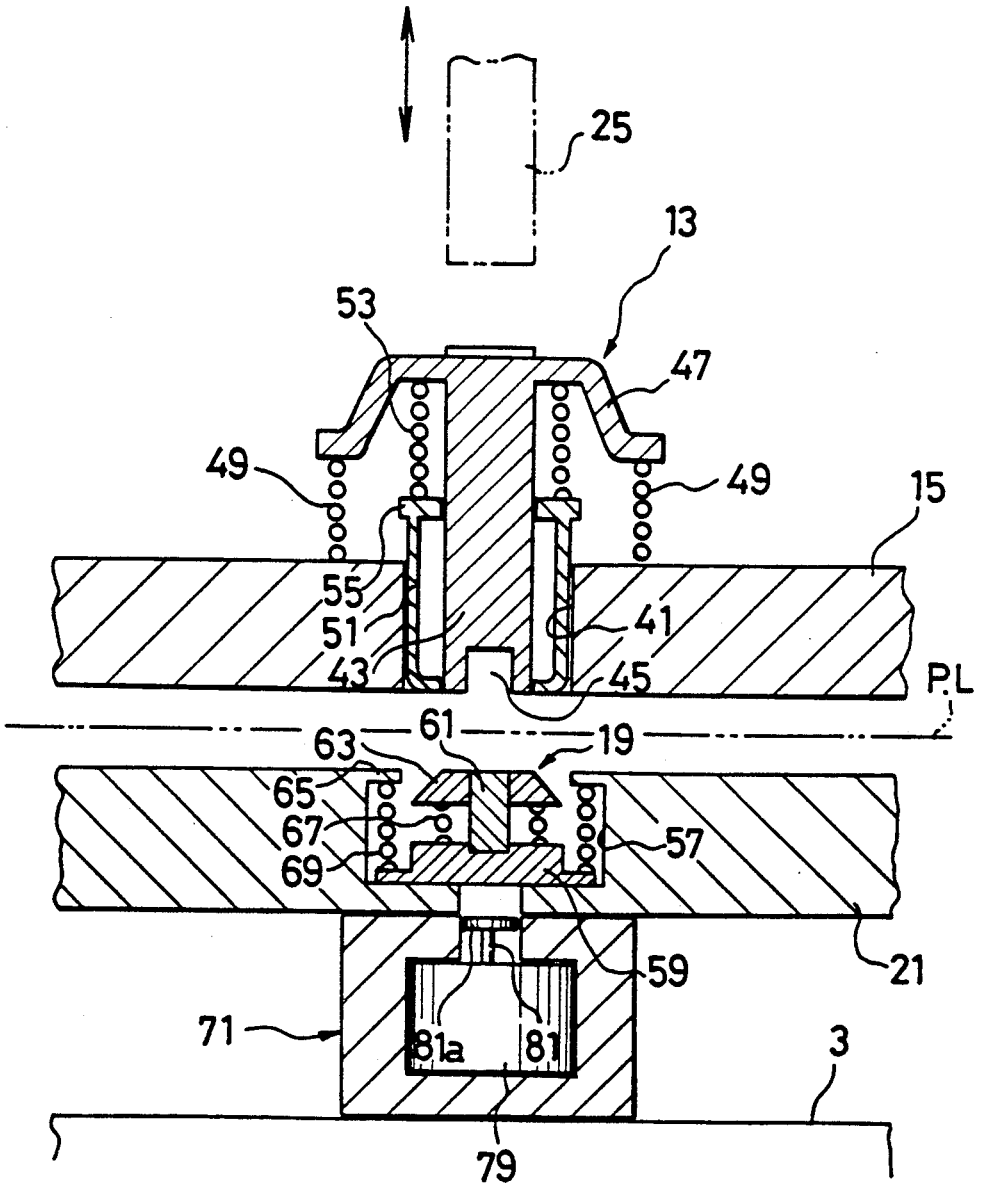
FIG. 5 is an enlarged section showing the upper and lower tools prior to the forming operation.
Figure 6:
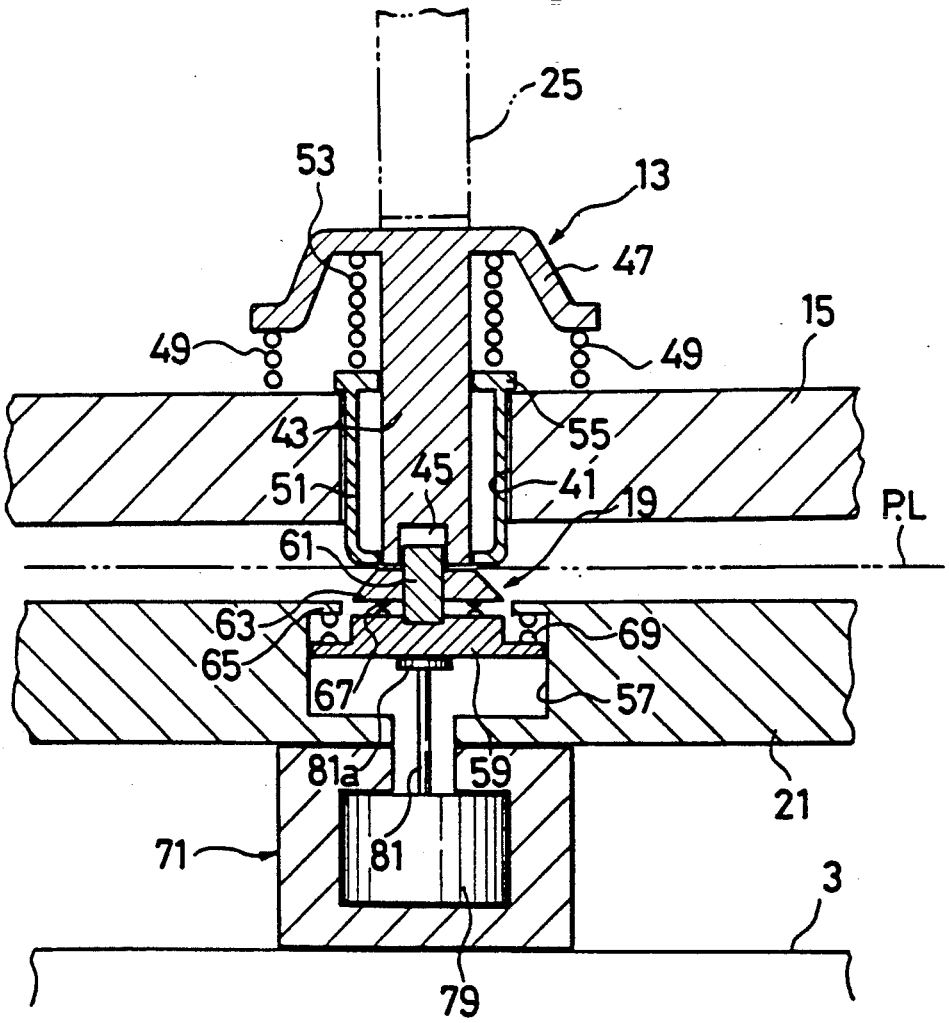
FIG. 6 is an enlarged section showing the upper and lower tools during the forming operation.

The disc support 23 contains a freely reciprocating movable block 71. The left end of the movable block 71 is connected to a piston rod 75 of a slide cylinder 73. The movable block 71 is formed as a rectangular parallelepiped to fit the inside configuration of the disc support 23. A through hole 77, through which punched scraps are dropped, is provided on the right half of the movable block 71. A press cylinder 79 with a piston rod 81 is embedded in the left half of the movable block 71 as means for pushing up the lower tool 19 for forming. A top 81*a* of the piston rod 81 pushes up the die holder 59, causing the lower tool 19 to project above the pass line PL (FIG. 6). During the punching operation, the piston rod 81 is retracted into the press cylinder 79, so that the lower tool 19 does not project above the pass line PL (FIG. 5).

In operation, as shown in FIGS. 7 and 8, the carriage 37 clamping the workpiece W moves in the X direction on the carriage base 35. In addition, the carriage base 35 moves on the guide rails 29 in the Y direction, so that the part of the workpiece W to be processed is positioned in the working area between the upper and lower turrets 15 and 21.

Figure 1:
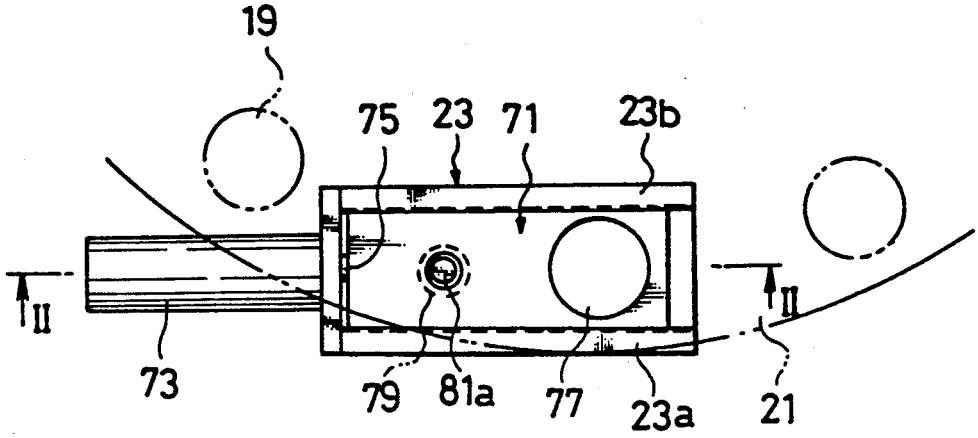
FIG. 1 is a plan view showing a disc support for a turret punch, in accordance with the invention, during a punching operation.
Figure 2:
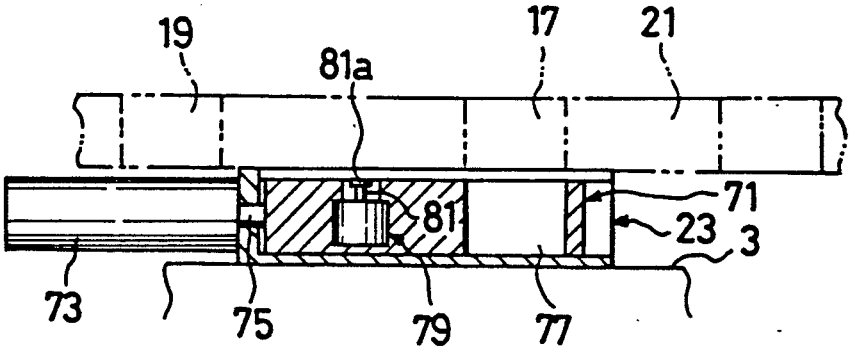
FIG. 2 is a section taken along the line II—II of FIG. 1.

In the punching operation, as shown in FIGS. 1 and 2, the desired upper and lower tools 11, 17 are positioned in the working area by synchronously rotating the upper and lower turrets 15, 21 by means of servo motors (not shown). The piston rod 75 of the slide cylinder 73 is then retracted to move the movable block to position the through hole 77 in the working area, after which the striker 25 actuates the upper tool 11. The punched scraps drop down through the through hole 77.

Figure 3:
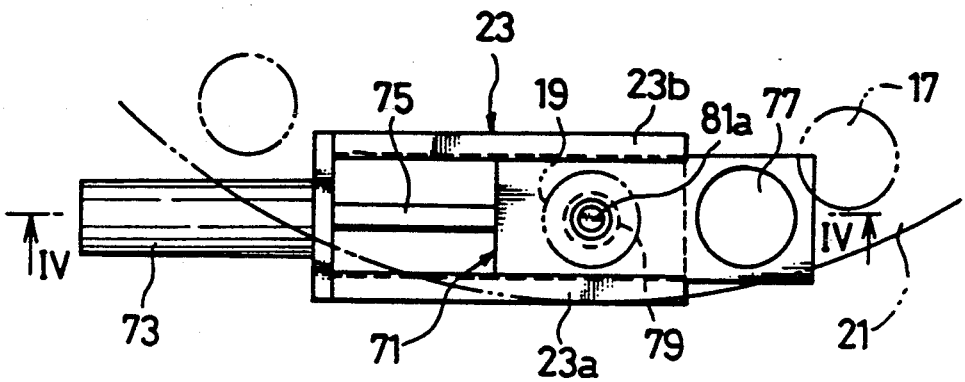
FIG. 3 is a plan view showing the disc support of the turret punch, in accordance with the invention, during a forming operation.
Figure 4:
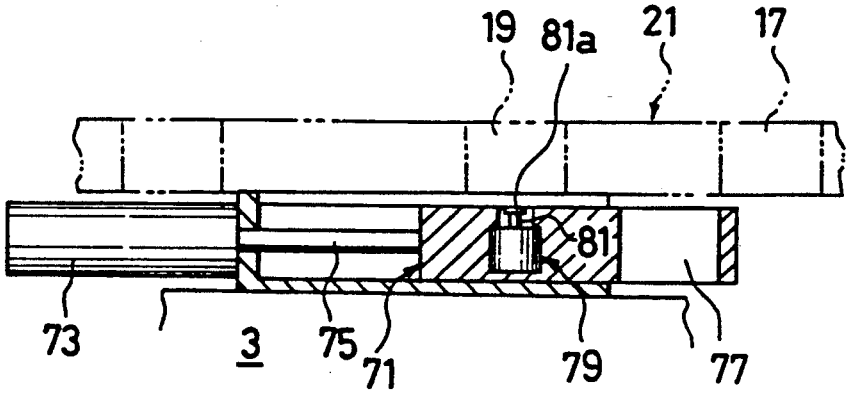
FIG. 4 is a section taken along the line IV—IV of FIG. 3.

In the forming operation, as shown in FIGS. 3 and 4, the part of the workpiece W to be processed is positioned in the working area between the upper and lower turrets 15, 21 in the same manner as stated above. The desired upper and lower tools are positioned in the working area by rotating the upper and lower turrets 15, 21 by means of the servo motors.

The piston rod 75 of the slide cylinder 73 is extended to move the movable block 71 to position the press cylinder 79 in the working area. The right end of the movable block 71 then projects from the aperture at the right side of the disc support 23 (FIGS. 3 and 4). At this stage, the piston rod 81 of the press cylinder 79 is retracted so that the lower tool 19 does not project above the pass line PL, as shown in FIG. 5. The piston rod 81 is then extended to push up the die holder 59, as shown in FIG. 6, so that the lower tool 19 projects above the pass line PL. The striker 25 strikes the upper end of the punch body 43 which descends accordingly together with the punch guide 51. The spring 53 also descends and is not compressed until the flange 55 of the punch guide 51 comes into contact with the upper face of the upper turret 15. When the striker 25 further descends, the punch body 43 descends compressing the spring 53, thus performing forming.

After completion of the forming process, the striker 25 is elevated and the spring 53 extends by its restoring force to press up the punch body 43. The striker 25 further ascends and then the spring 49 extends to raise the punch body 43 with the punch guide 51. On the other hand, the piston rod 81 of the press cylinder 79 is retracted and the die holder 59 with the die chip 61 is pressed down by the restoring force of the spring 69. Consequently, the work ejector 63 is raised with respect to the die holder 59 by the restoring force of the spring 67, thereby pushing up the workpiece W and releasing it from the die chip 61.

Alternatively, it is to be understood that after positioning the upper and lower tools 13, 19, the striker 25 can descend to the original bottom dead point so that the upper tool 13 abuts the upper surface of the upper turret 15. Thereafter the piston rod 81 of the press cylinder 79 can be extended to push up the die holder 59 to perform forming of the workpiece W. That is, pushing up the lower tool 19 for forming is equivalent to lowering the striker 25 with respect to the lower tool 19. The striker 19 is vertically actuated by a hydraulic cylinder.

According to the above embodiment, the disc support 23 is secured to the base 3 in the working area and the thickness of the side walls 23*a*, 23*b* is determined so that the cross-sectional area is greater than the predetermined area subject to pressure. Accordingly, the upper turret 21 is reliably supported during striking. Further, since the position of the lower tool is not changed with respect to the upper turret 15 and the upper tools 11, 13, high-precision processing can be obtained.

The upper and lower turrets 15, 21 are provided with tools for punching and forming, thus the tools can be readily changed only by rotating the turrets 15, 21. Further, the disc support 23 contains the movable block 71 having the press cylinder 79 to push up the lower tool 19, and the through hole 77 through which punched scraps are discharged. This means that the disc support 23 functions as both a support for the lower turret and a push-up means for the lower tool. If a support for the lower turret and a push-up means for the lower tool were provided separately, a changing operation would be required. According to the invention, however, punching and forming can be performed without such a changing operation.

The workpiece W can be processed without damage since the lower tool 19 for forming normally does not project above the path line PL and therefore does not interfere with the positioning operation of the workpiece W. When the turrets rotate after positioning the workpiece W at the working area, the workpiece W does not interfere with the lower tool for forming. Accordingly, the workpiece remains level, thus the workpiece W is properly processed.

While the above embodiment has been described with the movable block 71 with the through hole 77 on its right and the press cylinder on its left, and with the slide cylinder 73 at the left side, it should be understood that any other arrangement can be employed. Further, while the slide cylinder 73 is used to move the movable block 71, any other suitable means to control the positioning of the movable block 71, for example, a drive motor combined with a gear assembly could be employed.

What is claimed is:

1. A turret punch press, comprising:

a rotatable upper turret provided with at least an removable upper tool for punching and a removable upper tool for forming;

a rotatable lower turret, positioned to oppose said upper turret, provided with at least a removable lower tool for punching and a removable lower tool for forming which normally does not project above a pass line of a workpiece;

a vertically movable ram for acting on the upper and lower tools which are positioned in a working area where a workpiece is processed;

a disc support, provided at the working area under the lower turret, for supporting the lower turret;

said disc support, including means for pushing up the lower tool for forming, positioned in the working area so that the upper end of the lower tool projects above the pass line during a forming operation.

2. A turret punch press of claim 1, wherein said push-up means can move parallel to the pass line with respect to the lower turret.

3. A turret punch press of claim 2, wherein the disc support comprises a hollow block and a movable block contained therein, said push-up means being installed in the movable block.

4. A turret punch press of claim 3, further comprising a driving device to move the movable block so that the push-up means is located in the working area under the lower tool for forming in a forming operation.

5. A turret punch press of claim 3, wherein said movable block includes a through hole through which scraps are discharged.

6. A method for forming a workpiece for a turret punch press having rotatable upper and lower turrets, comprising steps of:

providing at least an upper tool for punching and an upper tool for forming on the upper turret;

providing at least a lower tool for punching and a lower tool for forming which normally does not project above a pass line of a workpiece;

providing a disc support in a working area where a workpiece is processed under the lower turret, for supporting the lower turret;

providing means for pushing up the lower tool for forming, positioned at the working area;

positioning the upper and lower tools for forming in the working area by rotating the upper and lower turrets;

pushing up the lower tools for forming so that the tops of the lower tools are projected above a pass line of the workpiece by means of said push-up means;

performing forming by actuating the upper and lower tools.

* * * * *

UNITED STATES PATENT AND TRADEMARK OFFICE

CERTIFICATE OF CORRECTION

PATENT NO. : 5,177,843

DATED : January 12, 1993

INVENTOR(S) : Tetsuji HAYASHI

It is certified that error appears in the above-indentified patent and that said Letters Patent is hereby corrected as shown below:

On THE TITLE PAGE:

Correct the name of the second named assignee by deleting the comma after "America". The names of the assignees should read:

Item [73] Amada Company, Ltd., Japan
Amada Mfg America Inc., La Mirada, Calif.

Signed and Sealed this

Twenty-fourth Day of September, 1996

Bruce Lehman

*Attest:*

BRUCE LEHMAN

*Attesting Officer*

*Commissioner of Patents and Trademarks*